US005525573A

United States Patent [19]

Uemura et al.

[11] Patent Number: 5,525,573

[45] Date of Patent: Jun. 11, 1996

[54] IMAGE RECEIVING SHEET FOR SUBLIMATION-TYPE THERMAL IMAGE TRANSFER RECORDING AND RECORDING METHOD USING THE SAME

[75] Inventors: Hiroyuki Uemura, Mishima; Chiharu Nogawa, Shizuoka-ken; Hidehiro Mochizuki, Numazu; Hiroki Kuboyama, Mishima; Yutaka Ariga, Fuji, all of Japan

[73] Assignee: Ricoh Company, Ltd., Tokyo, Japan

[21] Appl. No.: 309,462

[22] Filed: Sep. 21, 1994

[30] Foreign Application Priority Data

Sep. 21, 1993 [JP] Japan ..... 5-235068
Jun. 24, 1994 [JP] Japan ..... 6-166329

[51] Int. Cl.[6] ..... B41M 5/035; B41M 5/38

[52] U.S. Cl. ..... 503/227; 428/195; 428/318.4; 428/423.1; 428/447; 428/500; 428/913; 428/914

[58] Field of Search ..... 8/471; 428/195, 428/913, 914, 318.4, 423.1, 447, 500; 503/227

[56] References Cited

U.S. PATENT DOCUMENTS 4,880,768 11/1989 Mochizuki et al. .
4,931,423 6/1990 Uemura et al. .
4,985,397 1/1991 Uemura et al. .
5,019,550 5/1991 Suzuki et al. .
5,049,538 9/1991 Mochizuki et al. .
5,106,816 4/1992 Morohoshi et al. .
5,144,334 9/1992 Suzuki et al. .
5,286,706 2/1994 Mochizuki et al. .
5,302,575 4/1994 Nogawa et al. .
5,314,861 5/1994 Morohoshi et al. .
5,348,931 9/1994 Mochizuki et al. ..... 503/227

*Primary Examiner* Bruce Hess
*Attorney, Agent, or Firm* Oblon, Spivak, McClelland, Maier & Neustadt

[57] ABSTRACT

An image receiving sheet for sublimation-type thermal image recording includes substrate; and a dye receiving layer which is formed on the substrate directly or through an intermediate layer, the dye receiving layer including a dyeable cured resin and having a gel percentage of 70 wt. % or more. A sublimation-type thermal image transfer recording method for recording images by use of this image receiving sheet and a sublimation-type thermal image transfer recording medium is disclosed.

19 Claims, No Drawings

IMAGE RECEIVING SHEET FOR SUBLIMATION-TYPE THERMAL IMAGE TRANSFER RECORDING AND RECORDING METHOD USING THE SAME

BACKGROUND OF THE INVENTION

1. Field of the Invention

The present invention relates to an image receiving sheet for sublimation-type thermal image transfer and also to a sublimation-type thermal recording method using the image receiving sheet, utilizing a different running speed mode.

2. Discussion of Background

Recently the demand for full color printers is increasing year by year. Typical recording methods for full color printers now available include an electrophotographic method, an ink-Jet method, and a thermosensitive image transfer method. Of these methods, the thermosensitive image transfer method is most widely employed because of its advantages over the other methods in that the maintenance is easy and the operation is noiseless.

The thermosensitive image transfer recording method can be classified into two types, a thermal fusing image transfer method and a sublimation-type thermal image transfer recording method.

The thermal fusing image transfer type recording method is carried out by (i) superimposing (a) an image transfer sheet provided with an ink layer which comprises a thermofusible material and a coloring agent which is dispersed in the thermofusible material on (b) an image receiving sheet, and (ii) applying heat imagewise to the image transfer sheet to fuse the ink layer imagewise and to transfer the ink layer imagewise to the image receiving sheet, thereby recording transferred images on the image receiving sheet.

The sublimation-type thermal image transfer recording method is carried out by (i) superimposing (a) an image transfer sheet provided with an ink layer which comprises a sublimable dye or thermal transferable dye, which is hereinafter referred to a sublimable dye for simplicity, on (b) an image receiving sheet, and (ii) applying heat imagewise to the image transfer sheet to sublime or transfer imagewise the dye contained in the ink layer onto the image receiving sheet, thereby recording transferred images on the image receiving sheet.

The sublimation-type thermal image transfer recording method is generally more suitable for recording full color images than the thermal fusing recording method in view of the performance of faithful color tone reproduction by the sublimation-type image transfer recording method.

As the sublimation-type thermal image transfer recording method, a different running speed mode (n-times use mode) recording method is recently employed, in which both an image receiving sheet for sublimation image transfer (hereinafter simply referred to as the image receiving sheet) and a sublimation-type thermal image transfer sheet (hereinafter referred to as the image transfer sheet) are caused to run with the running speed of the image receiving sheet being made n (n>1) times the running speed of the image transfer sheet in order to perform repeated multiple recording.

In the conventional sublimation-type thermal image transfer recording method, there is employed an image receiving sheet which consists of a substrate (paper, synthetic paper, plastic film, etc.) end a dye receiving layer formed thereon, which dye receiving layer comprises a thermoplastic polyester resin or the like, which can be well dyed with a sublimation-type dye.

The above image receiving sheet, however, cannot be smoothly released from the image transfer sheet after the thermal image transfer recording is completed. Especially, when the different running speed mode recording method is employed, a strong friction works between the image transfer sheet and the image receiving sheet when image recording is performed, so that the two sheets tend to stick to each other or to be damaged.

Furthermore, in the different running speed mode recording method, when an image receiving sheet including a dye receiving layer with a gel percentage of less then 70 wt. % is employed, the dye receiving layer tends to be easily fused so that high energy cannot be applied thereto and accordingly images with high density cannot be obtained.

On the other hand, when an image receiving sheet including a dye receiving layer with a gel percentage of 100 wt. % is employed, the dye receiving layer is not fused so that high energy can be applied thereto and accordingly images with a single color having high density can be obtained. However, it is difficult for the dye transferred to be dispersed in the dye receiving layer because of the high gel percentage of the dye receiving layer so that the transferred dye stays near the surface of the dye receiving layer. As a result, a first dye transferred to the image receiving sheet is transferred back to the image transfer medium, so that images with high density, particularly, black images, cannot be obtained by subtractive mixing.

SUMMARY OF THE INVENTION

It is therefore a first object of the present invention to provide an image receiving sheet for sublimation-type thermal image recording having excellent surface releasability.

A second object of the present invention is to provide a sublimation-type thermal image transfer recording method, which is capable of producing images with high density even by subtractive mixing by use of the above-mentioned image receiving sheet in a different speed mode.

The first object of the present invention can be achieved by an image receiving sheet for sublimation-type thermal image recording which comprises (a) a substrate; and (b) a dye receiving layer formed on the substrate directly or through an intermediate layer, which dye receiving layer comprises a cured resin and has a gel percentage of 70 wt. % or more.

The second object of the present invention can be achieved by a sublimation-type thermal image transfer recording method for recording images comprising the steps of (i) superimposing (a) a sublimation-type thermal image transfer recording medium which comprises a plurality of overlaid ink layers, at least one of which comprises a sublimable dye, with the top ink layer thereof being a low dyeable resin layer, on (b) the above-mentioned image receiving sheet, and (li) applying heat imagewise to the image transfer recording medium to imagewise sublime or transfer the sublimable dye contained in the ink layer onto the image receiving sheet in a different running speed mode, in which both of the image receiving sheet and the sublimation-type thermal image transfer medium are caused to run with the running speed of the image transfer recording medium being set at 1/n (n>1) times the running speed of the image receiving sheet.

DESCRIPTION OF THE PREFERRED EMBODIMENTS

The present invention is based on the discovery that when a dyeable resin in an image receiving layer of an image receiving sheet is hardened, the surface releasability of the image receiving sheet is increased, and when the gel percentage of the image receiving layer is made 70 wt. % or more, the fusing or breaking of the image receiving sheet does not take place even when the image receiving sheet is employed in a different speed mode.

The present invention is also based on the discovery that when the above-mentioned image receiving sheet is employed in combination with a sublimation-type thermal image transfer recording medium which comprises a plurality of overlaid ink layers, at least one of which comprises a sublimable dye, with the top ink layer thereof being a low dyeable resin layer, images in a single color with high density can be produced even in a different speed mode, and it can be prevented that a dye transferred to the image receiving sheet is transferred back to the image transfer medium, and furthermore, images with high density can be obtained even by subtractive mixing.

In the present invention, the gel percentage of the dye receiving layer of the image receiving sheet is defined as the weight ratio of the insoluble portion of the dye receiving layer to the initial dye receiving portion when a 50 mm×100 mm image receiving sheet is immersed into 500 g of methyl ethyl ketone for 10 minutes.

In order to prevent the image receiving sheet from being fused or broken even when the speed difference is increased, that is, when n is increased in the different speed mode, it is preferable that the gel percentage of the dye receiving layer be set at 90 wt. % or more.

When a dyeable resin in the dye receiving layer is hardened, the surface releasability of the image receiving sheet can be significantly increased, but the dyeability of the dye receiving layer tends to be decreased. Therefore, It is preferable that the upper limit of the gel percentage of the dye receiving layer be set at about 99 wt. %.

The dyeable cured resin for use in the dye receiving layer can be obtained by curing a dye which exhibits excellent dyeability with respect to sublimable dyes.

Examples of such a dye having excellent dyeability with respect to sublimable dyes are conventionally employed dyes such as vinyl chloride resin, vinyl acetate resin, polyamide, polyethylene, polypropylene, polystyrene, acrylic resin, polyester, polycarbonate, polyurethane, epoxy resin, silicone resin, melamine resin, natural rubber, synthetic rubber, polyvinyl alcohol and cellulose resin. These resins can employed alone or in combination, or in the form of copolymers.

Of the above-mentioned resins, resins having active hydrogens and/or hydroxyl groups are preferable for use in the present invention. Furthermore, It is preferable that the resin for use in the dye receiving layer, before curing thereof, have 20 or more hydroxyl groups per one molecule of the resin for the curing thereof. The one molecule of such a resin is defined as a resin having an average polymerization degree being one molecule of the resin.

As a curing agent for curing such dyeable resins, conventionally employed curing agents can be employed. When resins having active hydrogens ere employed as the resins that can be dyed with sublimable dyes, it is preferable to employ an isocyanate compound as the curing agent.

As such an isocyanate compound, di- or tri-isocyanate compounds are particularly effective. Specific examples of such di- or tri-isocyanate compounds are 2,4-tolylene diisocyanate, 2,6-tolylene diisocyanate, 4,4-diphenylmethane diisocyanate, hexamethylene diisocyanate, xylene diisocyanate, triphenylmethane triisocyanate, isophorone diisocyanate, biscyanate methylcyclohexane, end trimethylhexamethylene diisocyanate.

It is preferable that the isocyanate compound having —NCO groups and the active-hydrogen containing resin having —OH groups be mixed with such a ratio that the ratio of the —NCO groups to the —OH groups is in the range of 0.1:1 to 1:1.

The dye receiving layer with the high gel ratio for use in the present invention, which is to be obtained by allowing the active-hydrogen containing resin to react with the isocyanate compound, cannot be obtained by merely coating a coating liquid for the formation of the dye receiving layer and drying the coated liquid, but it is further necessary to allow the coated dye receiving layer to stand at high temperature for an extended period of time for aging.

However, the aging at high temperature for an extended period of time is disadvantageous in terms of the production cost of the image receiving sheet. This problem can be solved by the addition of a curing catalyst to the coating liquid for the formation of the dye receiving layer, since the addition of the curing catalyst can ease the conditions for the high temperature aging.

As such a curing catalyst, acids, bases and metallic compounds are effective. In particular, for the reaction between the active-hydrogen containing resin end the isocyanate compound, tin-based catalysts are preferable.

Specific examples of such tin-based catalysts include dibutyltin oxide, dioctyltin oxide, tetrabutyltin, tin tetrachloride, dibutyltin laurate, dibutyltin dilaurate, dioctyltin dilaurate, butyltin trichloride, and dibutyltin diacetate.

For the improvement of the lubricating properties of the dye receiving layer, a lubricant may be added to the dye receiving layer. Specific examples of such a lubricant include petroleum lubricating oils such as liquid paraffin; synthetic lubricating oils such as hydrogen halogenide, diester oil, silicone oil, fluorine-contained silicone oil, modified (such as epoxy modified, amino modified, alkyl modified and polyether modified) silicone oils; silicone lubricating products such as copolymere of (a) organic compounds such as polyoxyalkylene glycol and (b) silicone; varieties of fluorine-contained lubricants such as fluoroalkyl compounds; waxes such as paraffin wax and polyethylene wax; higher fatty acid; higher aliphatic alcohol; higher fatty acid amide; higher fatty acid ester; and higher fatty acid salts.

It is preferable that the amount of such a lubricant to be added to the dye receiving layer be in the range of 5 wt. % to less than 30 wt. % of the entire weight of the dye receiving layer in order to have such a lubricant exhibit its lubricating effect effectively.

Furthermore, conventionally known additives such as surfactants, ultraviolet light absorbers, antioxidants, and fluorescent whitening agents may also be added to the dye receiving layer. It is preferable that the total amount of these additives be not more than 30 wt. % of the total weight of the dye receiving layer.

The image receiving sheet of the present invention can be produced by (i) coating a coating liquid for the formation of a dye receiving layer on a substrate made of a material such as paper, synthetic paper, or a resin film, directly or through a conventional intermediate layer such an adhesive layer or a heat-insulating layer, (ii) drying the coated liquid to form a dye receiving layer, and (iii) subjecting the coated dye receiving layer to aging at high temperature or to a curing treatment with application of heat thereto.

Generally it is preferable that the dye receiving layer have a thickness of about 1 to 20 μm.

As a substrate made of a resin film, a resin film containing micro bubbles therein is preferable for use in the present invention. This is because elasticity and heat insulating properties are imparted to such microbubbles containing film, so that such a micro-bubbles containing film is capable of preventing images formed in a different speed mode frame become rough and is also capable of preventing the lowering of the thermosensitivity in the image transfer in the different speed mode.

In view of the thermosensitivity, heat insulating properties, concealment performance, whiteness, and glossiness, a foamed type polyethylene terephthalate film (hereinafter referred to as PET film) is preferable as the substrate of the image receiving sheet of the present invention.

In order to prevent such a foamed type PET film from curling, two or more films may be laminated on the dye receiving layer with a structure, for example, PET film/paper, PET film/synthetic film, PET film/paper/PET film, or PET film/PET film/paper, in which the PET film is in contact with the dye receiving layer.

It is preferable to use an adhesive agent for fabricating the above-mentioned laminated substrate, with the curling thereof being prevented.

When the above-mentioned micro-bubbles containing film is used as the substrate for the image receiving sheet of the present invention, it is preferable that such a micro-bubbles containing film have a density D which satisfies the following formula:

$$\frac{(D_o - D)}{D_o} > 0.3$$

wherein $D_O$ is the density of a bubble-free film which is made of the same material as that for the micro-bubbles containing film.

A sublimation-type thermal image transfer recording medium for use with the image receiving sheet of the present invention comprises a plurality of overlaid ink layers, at least one of which comprises a sublimable dye, with the top ink layer thereof being a low dyeable resin layer.

The low dyeable resin layer is defined as follows:

On a commercially available synthetic paper (Trademark "Yupo FPG#95" made by Oji-Yuka Synthetic Paper Co., Ltd.) serving as a substrate base, a dye receiving layer is formed by coating a liquid prepared by adding a commercially available modified silicone oil (Trademark "SF8417/SF8411-1/1" made by Dow Corning Toray Silicone Co., Ltd.) with a resin solid component of 30 wt. % to a resin solution in which a resin solid component is dissolved in an amount of 5 to 20 wt. %, in such a manner that the thickness of the formed dye receiving layer is 10 μm on a dry basis by drying the coated liquid for 1 minute, and then at room temperature for more than one day.

On the thus formed dye receiving layer, there is superimposed of a cyan ribbon of a sheet cassette CK 2LB for Mitsubishi Color Video Copy Processor, and recording with 2.00 mJ/dot is performed by use of a commercially available thermal head (Trademark "KMT-85-6-MPD4" made by Kyocera Corporation) with a resolution of 6 dots/mm and an average resistance of 542 ohm, whereby images are formed on the image receiving layer. The density of the recorded images is then evaluated by use of a reflection type densitometer RD-918.

A resin layer with a density of 1.2 or less, preferably 1.0 or less, measured by the above-mentioned evaluation method, is defined as the low dyeable resin layer.

Preferable examples of a resin for use in the abovementioned low dyeable resin layer are aromatic polyester resin, styrene butadiene resin, polyvinyl acetate resin and polyamide resin; and furthermore preferable examples of such a resin are methacrylate resin or copolymers thereof, styrene-maleic acid ester copolymer, polyimide resin, acetate resin, silicone resin, styrene acrylonitrile resin end polysulfone resin.

Of the above-mentioned resins, silicone resin is particularly preferable for use in the above-mentioned top ink layer because of excellent low dyeability and fusing preventing performance, required for the low dyeable resin layer when used in the different speed mode. More specifically, silicone resin is provided with excellent heat resistance and releasability.

The low dyeable resin layer may also comprise a mixture of a plurality of different resins.

Sublimable dyes for use in the overlaid ink layers of the sublimation-type thermal image transfer recording medium are such dyes that sublime or ere evaporated when heated to 60° C. or more and can be used for thermal transfer textile printing, for example, disperse dyes and oil-soluble dyes.

Specific examples of sublimable dyes for use in the sublimation-type thermal image transfer recording medium include C.I. Disperse Yellows 1, 3, 8, 9, 16, 41, 54, 60, 77 and 116; C.I. Disperse Rede 1, 4, 6, 11, 15, 17, 55, 59, 60, 73 and 83; C.I. Disperse Blues 3, 14, 19, 26, 56, 60, 64, 72, 99 and 108; C.I. Solvent Yellows 77 and 116; C.I. Solvent Reds 23, 25 and 27; and C.I. Solvent Blues 36 and 105. These dyes can he used alone or in combination.

As binder agents for use in the overlaid ink layers, thermoplastic resins and thermosetting resins can be employed. Specific examples of such resins include vinyl chloride resin, vinyl acetate resin, polyamide, polyethylene, polycarbonate, polystyrene, polypropylene, acrylic resin, phenolic resin, polyester, polyurethane, epoxy resin, silicone resin, phenolic resin, butyral resin, melamine resin, natural rubber, synthetic rubber, polyvinyl alcohol and cellulose resin. These resins can be used alone, in combination, or in the form of copolymers.

It is preferable that the thickens of the ink layer which is composed of a plurality of overlaid ink layers of the sublimation-type thermal image transfer recording medium be in the range of 0.5 to 20 μm, and more preferably in the range of 1 to 10 μm in view of the thermal response and multiple printing performance of the image transfer recording medium.

Furthermore, it is preferable that the concentration of the sublimable dye in the ink layer be in the range of 5 to 80 wt. % of the entire weight of the ink layer, and more preferably in the range of 50 to 80 wt. % in view of the thermal response and multiple printing performance of the image transfer recording medium.

In order to supply the sublimable dye to the image receiving sheet stably and continuously for an extended period of time, thereby maintaining excellent printing performance, it is preferable that the ink layer of the o,age transfer recording medium includes a dye supply layer which contains the sublimable dye in the state of undissolved particles.

The undissolved particles of the dye can be formed when the dye cannot be completely dissolved in an organic binder agent in the course of the preparation of a coating liquid for the formation of the ink layer, which comprises the organic binder agent, the sublimable dye and a solvent, and is separated in the form of particles when the coating liquid is dried. Thus the state of undissolved particles of the dye differs depending upon the kind of solvent employed for the preparation of the coating liquid even when the employed binder agent and dye are the same.

The presence of such undissolved particles of the dye can be easily recognized by the observation of the dye supply layer by an electron microscope. It is preferable that the particle size of such undissolved dye particles be in the range of 0.01 to 20 μm, more preferably in the range of 1.0 to 5 μm, although e suitable particle size differs depending upon the thickness of the dye supply layer.

It is also preferable that a dye transfer contribution layer which contributes to the transfer of the sublimable dye from the dye supply layer to the low dyeable resin layer be interposed between the dye supply layer and the low dyeable resin layer as proposed in Japanese Laid-Open Patent Application 5-64980.

With respect to the amount of the dye that is transferred from the dye supply layer and the amount of the dye that is transferred from the dye transfer contribution layer, the dye supply layer and the dye transfer contribution layer are in the following relationship that the former amount is larger than the latter amount when the dye supply layer and the dye transfer layer are separately farmed with an identical deposition amount on an identical substrate, and the same image receiving sheet is superimposed on each of the dye supply layer and the dye transfer layer and the same amount of thermal energy is applied to both of the dye supply layer end the dye transfer layer.

It is considered that Fick's law of diffusion can be applied to the diffusion of the dye in the ink layer. Namely, the following relationship can be applied to the diffusion of the dye in the ink layer:

$$dn=-D\times(dc/dx)\times q\times dt$$

wherein dn is the amount of the dye which passes through a cross section q per unit time, dc/dx is the concentration gradient of the dye in the direction of the diffusion thereof, and D is the average diffusion coefficient at each portion in the ink layer when heat is applied thereto.

There are the following means in order to facilitate the supply of the sublimable dye by diffusion from the dye supply layer to the dye transfer contribution layer;

(1) Establishing the relationship between the concentration of the sublimable dye in the dye supply layer and the concentration of the sublimable dye in the dye transfer contribution layer as the former being larger than the latter, namely, with respect to the concentration of the sublimable dye, dye supply layer>dye transfer contribution layer.

(2) Establishing the relationship between the diffusion coefficient of the sublimable dye in the dye supply layer and the diffusion coefficient of the sublimable dye in the dye transfer contribution layer as the former being larger than the latter, namely, with respect to the diffusion coefficient of the sublimable dye, dye supply layer>dye transfer contribution layer.

It is preferable that each of the dye transfer contribution layer and the low dyeable resin layer have a thickness in the range of 0.05 to 5 μm, more preferably in the range of 0.1 to 2 μm. Furthermore, it is preferable that the dye supply layer have a thickness of 0.1 to 20 μm, more preferably in the range of 0.5 to 10 μm.

As the sublimable dyes, binder agents and other components for use in the dye transfer contribution layer and the dye supply layer, conventional sublimable dyes, binder agents and other components can be employed.

In order to make the diffusion coefficient of the dye supply layer different from that of the dye transfer contribution layer, it is preferable that a resin, natural rubber, or synthetic rubber with a glass transition temperature of 0° C. or less, or a softening point of 60° C. or less, be mixed with one or more of the previously mentioned thermoplastic resins or thermosetting resins.

Specific examples of such a resin or the like with a glass transition temperature of 0° C. or less, or a softening point of 60° C. or less, are polyethylene oxide (Trademark "Alkox E-30, 45, R-150, 400, 1000" made by Meisei Chemical Works, Ltd.); and caprolactone polyol (Trademark "Placcel H-1, 4, 7 made by Daicel Chemical Industries, Ltd.).

The concentration of the sublimable dye to be contained in the dye transfer contribution layer and the low dyeable resin layer is generally in the range of 0 to 80 wt. %, preferably in the range of about 10 to 60 wt. %. It is preferable that the concentration of the dye in the dye supply layer be in the range of 5 to 80 wt. %, but when a dye concentration gradient is placed between the dye transfer contribution layer and the dye supply layer, it is preferable that the concentration of the dye in the dye supply layer be in the range of 1.1 to 5 times, more preferably in the range of 1.5 to 3 times the concentration of the dye in the dye transfer contribution layer.

It is preferable that in the dye transfer contribution dye and the low dyeable resin layer, the sublimable dye be dispersed in the state of individually separated molecules which can be contributed to the actual dye transfer in order to prevent uneven dye transfer and to maintain stably the dye concentration gradient between the dye supply layer and the dye transfer contribution layer.

In each of the overlaid layers which constitute the ink layer, conventional additives, such as lubricant, curing agent, and antioxidant, may be contained.

As the substrate for use in the image receiving sheet, films such as condenser paper, polyester film, polystyrene film, polysulfone film, polyimide film and aromatic polyamide film.

When necessary, a conventional adhesive layer may be interposed between such a substrate film and the dye supply layer. Furthermore, when necessary, a conventionally employed heat resistant lubricating layer may be provided on the back side of the substrate film.

As to the ink layer, an example of the ink layer composed of three overlaid layers has been so far discussed. However, the ink layer may be composed of two overlaid layers or four or more overlaid layers, as long at the dye concentration gradient and dye diffusion coefficient gradient which comply with the object of the present invention can be obtained, with the necessary difference in the dye transfer being set in the respective overlaid layers for the function separation thereof.

So far, the recording method by use of a thermal head has been exemplified for explanation. However, the sublimation-type thermal image transfer recording medium for use in the present invention can be applied to other recording methods, such as a method using a thermal printing plate, a method using laser beams, and a method using Joule's heat which is generated within the image transfer medium. Of these method, the image transfer method utilizing Joule's heat, which is referred to as the electrothermic non-impact recording method, is disclosed, for instance, in U.S. Pat. No. 4,103,066, and Japanese Laid-Open Patent Applications 57-14060, 57-11080, and 59-9096.

As the substrate for this electrothermic non-impact recording method, (1) a substrate comprising (a) a resin with relatively good heat resistance such as polyester, polycarbonate, triacetyl cellulose, nylon, polyimide or aromatic polyamide, and (b) an electroconductive powder, for example, metallic powder of aluminum, copper, iron, tin, zinc, nickel, molybdenum or silver, and/or carbon black, which is dispersed in the heat resistant resin in such a manner that the resistivity thereof is adjusted to a resistivity between that of an insulator and that of a good conductor, and (2) a substrate comprising the abovementioned resin, with the above-mentioned electroconductive metal being deposited in vacuum or sputtered thereon. It is preferable that such a substrate have a thickness of about 2 to 15 μm, with the transfer efficiency of Joule's heat taken into consideration.

When a laser beam image transfer method is employed, a substrate which is capable of absorbing laser beams is employed. Examples of such a substrate are a substrate comprising a conventional thermal transfer film and a light absorbing and light-to-heat converting agent, such as carbon which is dispersed in the thermal transfer film, and a substrate comprising a conventional thermal transfer film and a laser beam absorbing layer being provided on both sides of the thermal transfer film.

The features of this invention will become apparent in the course of the following description of exemplary embodiments, which are given for illustration of the invention and are not intended to be limiting thereof:

EXAMPLE 1

Preparation of Dye Receiving Layer Formation Liquid

A mixture of the following components was dispersed to prepare a dye receiving layer formation liquid:

| | Parts by Weight |
|---|---|
| Polyester resin (Trademark "Vylon 200" made by Toyobo Co., Ltd.) | 18 |
| Isocyanate compound (Trademark "Cronate L" made by Nippon Polyurethane Industry) | 5 |
| Silicone oil (Trademark "SP8417" made by Dow Corning Toray Silicone Co., Ltd.) | 1 |
| Silicone oil (Trademark "SF8411" made by Dow Corning Toray Silicone Co., Ltd.) | 1 |
| Toluene | 40 |
| Methyl ethyl ketone | 40 |

The thus prepared dye receiving layer formation liquid was coated on a commercially available synthetic paper (Trademark "Yupo" made by Oji-Yuka Synthetic Paper Co., Ltd.) and dried, whereby a dye receiving layer with a thickness of 6 μm on a dry basis was formed on the synthetic paper. The thus formed dye receiving layer was subjected to a heat treatment at 110° C. for 2 hours, whereby an image receiving sheet No. 1 of the present invention was prepared.

EXAMPLE 2

The procedure of the preparation of the image receiving sheet No. 1 in Example 1 was repeated except that 0.1 parts by weight of a commercially available tin catalyst (Trademark "TKIL" made by Takeda Chemical Industries, Ltd.) was added to the dye receiving layer formation liquid, and that the formed dye receiving layer was not subjected to the heat treatment in Example 1, but was subjected to an aging treatment at 60° for 4 days, whereby an image receiving sheet No. 2 of the present invention was prepared.

EXAMPLE 3

The procedure of the preparation of the image receiving sheet No. 1 in Example 1 was repeated except that the polyester resin in the dye receiving layer formation liquid employed in Example 1 was replaced by a commercially available vinyl chloride resin (Trademark "VAGH" made by Union Carbide Japan K.K.), whereby an image receiving sheet No. 3 of the present invention was prepared.

EXAMPLE 4

The procedure of the preparation of the image receiving sheet No. 1 in Example 1 was repeated except that the formed dye receiving layer was not subjected to the heat treatment in Example 1, but was subjected to an aging treatment at 80° for 5 days, whereby an image receiving sheet No. 4 of the present invention was prepared.

COMPARATIVE EXAMPLE 1

The procedure of the preparation of the image raeclying sheet No. 1 in Example 1 was repeated except that the isocyanate compound was eliminated from the dye receiving layer formation liquid employed in Example 1, whereby a comparative image receiving sheet No. 1 was prepared.

COMPARATIVE EXAMPLE 2

The procedure of the preparation of the image receiving sheet No. 1 in Example 1 was repeated except that the formed dye receiving layer was not subjected to the heat treatment in Example 1, but was subjected to an aging treatment at 60° for 10 days, whereby a comparative image receiving sheet No. 2 was prepared.

Evaluation Tests

Preparation of Sublimation-type Thermal Image Transfer Recording Medium

A mixture of the following components was dispersed, whereby an ink layer formation liquid was prepared:

| | Parts by Weight |
|---|---|
| Polyvinyl butyral resin (Trademark "BX-1" made by Sekisui Jushi Corporation) | 10 |
| Sublimable dye (Trademark "Kayaset Blue 714" made by Nippon Kayaku Co., Ltd.) | 25 |
| Isocyanate compound (Trademark "Coronate L" made by Nippon Polyurethane Industry) | 10 |
| Silicone oil (Trademark "SF8417" made by Dow Corning Toray Silicone Co., Ltd.) | 1.5 |
| Toluene | 100 |
| Methyl ethyl ketone | 100 |

The thus prepared ink layer formation liquid was coated on an aromatic polyamide film serving as a substrate, and dried, whereby a sublimable dye layer serving as an ink layer was formed on the aromatic polyamide film. Thus a sublimation-type thermal image transfer recording medium for use in the sublimation-type thermal image transfer recording method of the present invention was prepared.

Recording Conditions

Each of the image receiving sheets Nos. 1 to 4 of the present invention was superimposed on the ink layer of the above fabricated sublimation-type thermal image transfer recording medium, and recording evaluation tests were conducted under the following conditional

| | |
|---|---|
| Applied electric power | 442 mW/dot |
| Thermal head | 6 dots/mm |
| Running speed of image receiving sheet/Running speed of image transfer recording medium = 7 to 30 | |
| Maximum applied energy | 2.21 mJ/dot |

The results of these evaluation tests are shown in the following TABLE 1:

TABLE 1

| | Gel percentage | Fusibility | Image Density |
|---|---|---|---|
| Ex. 1 | 100 | ⊙ | 1.5 |
| Ex. 2 | 97 | ○ | 1.9 |
| Ex. 3 | 98 | ⊙ | 1.9 |
| Ex. 4 | 75 | Δ | 2.0 |
| Comp. Ex. 1 | 0 | xx | — |
| Comp. Ex. 2 | 60 | x | — |

In the above TABLE 1, the test of the fusibility was performed by investigating the maximum speed difference between the running speed of the image receiving sheet and the running speed of the sublimation-type thermal image transfer recording medium at which no fusing of the ink layer to the image receiving sheet took place, when the two running speeds were changed. This investigation was performed by observing the formation of untransferred white lines, uneven transfer, or the presence or absence of the traces of wrinkles of the image transfer recording medium in the transferred images, or the transfer of the ink layer to the image receiving sheet.

In the above table, O denotes that no fusing was observed place until the ratio of the running speed of image receiving sheet/running speed of the image transfer recording medium was increased to 30; O denotes that no fusing was observed until the running speed ratio was increased to 20; Δ denotes that no fusing was observed until the running speed ratio was increased to 20, but the running of the image receiving sheet and the image transfer recording medium became uneven when the running speed ratio reached 20; x denotes that fusing was observed when the running speed ratio reached 15; and xx denotes that the image transfer sheet was damaged when the running speed radio reached 7.

The image densities provided in the above TABLE 1 were obtained by performing recording gradation test patterns on each image receiving sheet, and by measuring the maximum image density thereof by use of a Macbeth densitometer.

The results shown in TABLE 1 indicate that no fusing took place in the image receiving sheets of the present invention when used under the different running speed mode recording.

EXAMPLE 5

The procedure of the preparation of the image receiving sheet No. 1 in Example 1 was repeated except that the polyester resin in the dye receiving layer formation liquid employed in Example 1 was replaced by a commercially available vinyl chloride resin (Trademark "1000 GKT" made by Denki Kagaku Kogyo Kabushiki Kaisha, having 34 hydroxyl groups per molecule of the vinyl chloride resin), whereby an image receiving sheet No. 5 of the present invention was prepared.

EXAMPLE 6

The procedure of the preparation of the image receiving sheet No. 5 in Example 5 was repeated except that the vinyl chloride resin in the dye receiving layer formation liquid employed in Example 5 was replaced by a commercially available polyester resin (Trademark "Vylon 290" made by Toyoho Co., Ltd., having 2.6 hydroxyl groups per molecule of the polyester resin), whereby an image receiving sheet No. 6 of the present invention was prepared.

The gel percentage and fusibility of each of the dye receiving layers of the image receiving sheets Nos. 5 and 6 were as follows:

TABLE 2

| | Number of OH groups per molecule | Gel percentage | Fusibility |
|---|---|---|---|
| Ex. 5 | 34 | 98 | ⊙ |
| Ex. 6 | 2.6 | 82 | Δ |

The marks for the fusibility in the above TABLE 2 are respectively the same as in the previous TABLE 1.

The results shown in the above TABLE 2 indicate that the larger the number of hydroxyl groups per molecule of the resin employed, the better the fusibility of the image receiving sheet.

EXAMPLE 7

The procedure of the preparation of the image receiving sheet No. 3 in Example 3 was repeated except that the isocyanate compound in the dye receiving layer formation liquid employed in Example 3 was replaced by a commercially available isocyanate compound (Trademark "Takenate D218", tolylene diisocyanate trimer, made by Takeda Chemical Industries, Ltd.), whereby an image receiving sheet No. 7 of the present invention was prepared.

EXAMPLE 8

The procedure of the preparation of the image receiving sheet No. 7 in Example 7 was repeated except that the isocyanate compound employed in the dye receiving layer formation liquid in Example 7 was replaced by a commercially available isocyanate compound ((Trademark "Takenate D160N" made by Takeda Chemical Industries, Ltd., an adduct of hexamethylene diisocyanate and trimethylol propane, made by Takeda Chemical Industries, Ltd.), whereby an image receiving sheet No. 8 of the present invention was prepared.

The gel percentage and fusibility of each of the dye receiving layers of the image receiving sheets Nos. 7 and 8 were as follows:

TABLE 3

| | Isocyanate compound | Gel percentage | Fusibility |
|---|---|---|---|
| Ex. 7 | Aromatic | 97 | ⊙ |
| Ex. 8 | Aliphatic | 85 | ○ |

The results shown in the above TABLE 2 indicate that the aromatic isocyanate compound employed in Example 7 is better than the aliphatic isocyanate compound employed in Example 8 with respect to the fusibility because the aromatic isocyanate compound is more reactive than the aliphatic isocyanate compound.

EXAMPLE 9

The procedure of the preparation of the image receiving sheet No. 3 in Example 3 was repeated except that the synthetic paper employed as the substrate in Example 3 was replaced by a commercially available bubbles-containing PET film (Trademark "Crisper G" made by Toyobo Co., Ltd.), whereby an image receiving sheet No. 9 of the present invention was prepared.

EXAMPLE 10

The procedure of the preparation of the image receiving sheet No. 3 in Example 3 was repeated except that the synthetic paper employed as the substrate in Example 3 was replaced by a composite substrate comprising a bubbles-containing PET film (Trademark "Crisper G" made by Toyoho Co., Ltd.), a white PET film (Trademark "E 20" made by Toray Industries, Inc.), and a synthetic paper (Trademark "Yupo" made by Oji-Yuka Synthetic Paper Co., Ltd.) which were successively laminated, with the dye receiving layer being provided on the bubbles-containing PET film, whereby an image receiving sheet No. 10 of the present invention was prepared.

EXAMPLE 11

The procedure of the preparation of the image receiving sheet No. 3 in Example 3 was repeated except that the synthetic paper employed as the substrate in Example 3 was replaced by a composite substrate comprising a bubbles-containing PET film (Trademark "E 60" made by Toray Industries, Inc.), a white PET film (Trademark "E 20" made by Toray Industries, Inc.), and a synthetic paper (Trademark "Yupo" made by Oji-Yuka Synthetic Paper Co., Ltd.) which were successively laminated, with the dye receiving layer being provided on the bubbles-containing PET film, whereby an image receiving sheet No. 11 of the present invention was prepared.

The density of each of the bubbles-containing PET films employed in the image receiving sheets Nos. 9 to 11 was measured. Furthermore, the image densities at two different spots of each of the image receiving sheets Nos. 9 to 11 were measured, with the application of a different amount of energy thereto, under the same conditions as previously mentioned in the evaluation tests.

Furthermore, the curling of each of the image receiving sheets Nos. 9 to 11 was inspected after the thermal printing.

The results of the above tests are shown in the following TABLE 4:

TABLE 4

| | $(D_o-D)/D$ | Image Density (1) | Image Density (2) | Curling |
|---|---|---|---|---|
| Ex. 9 | 0.21 | 1.0 | 1.7 | Much |
| Ex. 10 | 0.21 | 1.1 | 1.7 | Slight |
| Ex. 11 | 0.38 | 1.3 | 1.9 | Slight |

The results shown in TABLE 4 indicate that when the density of the bubbles-containing PET film, $(D_o-D)/D$, is larger than 0.3, the obtained thermosensitivity is improved in view of the image densities obtained in Example 11. Furthermore, when the substrate is a composite substrate as in Examples 10 and 11, the curling of the image receiving sheet is reduced.

The above results indicate that it is preferable that the density of the bubbles-containing PET film, $(D_o-D)/D$, be larger than 0.3, and that the substrate be a composite substrate for use in the present invention.

EXAMPLE 12

(1) Fabrication of Yellow, Magenta and Cyan Sublimation-type Thermal Image Transfer Recording Media Preparation of Intermediate Adhesive Layer Formation Liquid A mixture of the following components was dispersed, whereby an intermediate adhesive layer formation liquid was prepared:

| | Part by Weight |
|---|---|
| Polyvinyl butyral resin (Trademark "BX-1" made by Sekisui Chemical Co., Ltd.) | 10 |
| Diisocyanate (Trademark "Coronate L" made by Nippon Polyurethane Industry) | 5 |
| Toluene | 95 |
| Methyl ethyl ketone | 95 |

The thus prepared intermediate adhesive layer formation liquid was coated by a wire bar on an aromatic polyamide film with a thickness of 6 μm, provided with a silicone resin based heat insulating layer with a thickness of 1 μm on the back side thereof, and was then coated, whereby an intermediate adhesive layer with a thickness of 1.0 μm on a dry basis was formed on the aromatic polyamide film.

Preparation of Dye Supply Layer Formation Liquid

A mixture of the following components was dispersed, whereby a dye supply layer formation liquid was prepared:

| | Parts by Weight |
|---|---|
| Polyvinyl butyral resin (Trademark "BX-1" made by Sekisui Chemical Co., Ltd.) | 7 |
| Polyethylene oxide (Trademark "Alkox R400" made by Meisei Chemical Works, Ltd.) | 3 |
| Diisocyanate (Trademark "Coronate L" made by Nippon Polyurethane Industry) | 3 |
| Sublimable dye | 30 |
| Toluene | 95 |
| Methyl ethyl ketone | 95 |

The thus prepared dye supply layer formation liquid was coated by a wire bar on the intermediate adhesive layer and was dried, whereby a dye supply layer with a thickness of 4.5 μm on a dry basis was formed on the intermediate adhesive layer.

Preparation of Dye Transfer Contribution Layer Formation Liquid

A mixture of the following components was dispersed, whereby a dye transfer contribution layer formation liquid was prepared:

| | Parts by Weight |
|---|---|
| Polyvinyl butyral resin (Trademark "BX-1" made by Sekisui Chemical Co., Ltd.) | 10 |
| Diisocyanate (Trademark "Coronate L" made by Nippon Polyurethane Industry) | 3 |
| Sublimable dye | 20 |
| Toluene | 45 |
| Methyl ethyl ketone | 45 |
| Dioxane | 100 |

The thus prepared dye transfer contribution layer formation liquid was coated by a wire bar on the dye supply layer and was dried, whereby a dye transfer contribution layer with a thickness of 0.5 μm on a dry basis was formed on the dye supply layer.

Preparation of Low Dyeable Resin Layer Formation Liquid

A mixture of the following components was dispersed, whereby a low dyeable layer formation liquid was prepared:

| | Parts by Weight |
|---|---|
| Styrene-malaic acid copolymer (Trademark "Suprapal AP20" made by BASF Japan Ltd.) | 5 |
| Silicone oil (Trademark "SF8417" made by Dow Corning Toray Silicone Co., Ltd.) | 0.75 |
| Silicone oil (Trademark "SF8411" made by Dow Corning Toray Silicone Co., Ltd.) | 0.75 |
| Toluene | 47.5 |
| Methyl ethyl ketone | 47.5 |

The thus prepared low dyeable layer formation liquid was coated by a wire bar on the dye transfer contribution layer and was dried, whereby a low dyeable resin layer with a thickness of 0.7 μm on a dry basis was formed on the dye transfer contribution layer.

In the dye supply layer and the dye transfer contribution layer, one of the following sublimable dyes was employed as the sublimable dye:

Yellow sublimable dye (Trademark "Foron Brilliant Yellow S-6GL" made by Sandoz K.K.), Magenta sublimable dye (Trademark "MM1041" / Trademark "Hso147" - 6/4 made by Mitsui Toatsu Dyes, Ltd.), and Cyan sublimable dye (Trademark "Hso271" (made by sandoz K.K.) / Trademark "Foron Brilliant Blue SR" (made by Mitsui Toatsu Dyes, Ltd.) - 9/1).

Thus, a composite sheet comprising the aromatic polyamide film on which the intermediate adhesive layer, the dye supply layer, the dye transfer contribution layer, and the low dyeable resin layer were successively overlaid was prepared.

The thus prepared composite sheet was then subjected to a thermosetting curing process at 60° C. for 12 hours, whereby a sublimation-type thermal image transfer recording medium was prepared. By replacing the sublimable dye by one of the previously mentioned sublimable yellow, magenta and cyan dyes, magenta, yellow and cyan image transfer recording media were prepared.

(2) Fabrication of Image Receiving Sheet No. 12

Preparation of Dye Receiving Layer

A mixture of the following components was dispersed, whereby a dye receiving layer formation liquid was prepared.

| | Parts by Weight |
|---|---|
| Vinyl chloride resin (Trademark "VAGH" made by Union Carbide Japan K.K.) | 18 |
| Diisocyanate (Trademark "Coronate L" made by Nippon Polyurethane Industry) | 5 |
| Silicone oil (Trademark "SF8417" made by Dow Corning Toray Silicone Co., Ltd.) | 1 |
| Silicone oil (Trademark "SF8411" made by Dow Corning Toray Silicone Co., Ltd.) | 1 |
| Toluene | 40 |
| Methyl ethyl ketone | 40 |

The thus prepared dye receiving layer formation liquid was coated on a bubbles-containing PET film and dried, whereby a dye receiving layer with a thickness of 6 μm on a dry basis was formed on the bubbles-containing PET film. The thus prepared dye receiving layer was then subjected to an aging treatment at 80° C. for 5 days, whereby an image receiving sheet No. 12 of the present invention was prepared.

EXAMPLE 13

The procedure of the preparation of the image receiving sheet No. 12 in Example 12 was repeated except that 0.1 parts by weight of a commercially available tin catalyst (Trademark "TKIL" made by Takeda Chemical Industries, Ltd.) was added to the dye receiving layer formation liquid, and that the formed dye receiving layer was subjected to an aging treatment at 60° for 4 days, whereby an image receiving sheet No. 13 of the present invention was prepared.

EXAMPLE 14

The formulation of the low dyeable resin layer for the sublimation-type thermal image transfer recording medium employed in Example 12 was changed to the following formulation, whereby a sublimation-type thermal image transfer recording medium was prepared:

| | Parts by Weight |
|---|---|
| Styrene-maleic copolymer (Trademark "Suprapal AP20" made by BASF Japan Ltd.) | 5 |
| Liquid A | 20 |
| n-Butanol | 20 |

In the above formulation, Liquid A was prepared by dissolving 15 g of dimethylmethoxy silane and 9 g of methyltrimethoxy silane in a mixed solvent of 12 g of toluene and 12 g of methyl ethyl ketone, and hydrolyzing this solution, with the addition of 13 ml of 3 % sulfuric acid thereto, for 3 hours.

In this example, the same image receiving sheet as employed in Example 13 was employed.

EXAMPLE 15

The procedure in Example 14 was repeated by using the same image transfer recording medium as employed in Example 14 except that the image receiving sheet was subjected to a heat treatment at 110° C. for 2 hours instead of subjecting the image receiving sheet to the aging at 60° C. for 4 days.

COMPARATIVE EXAMPLE 3

The procedure in Example 12 was repeated by using the same image transfer recording medium as employed in Example 12 except that the image receiving sheet was subjected to a heat treatment at 60° C. for 10 days instead of subjecting the image receiving sheet to the aging at 80° C. for 5 days.

COMPARATIVE EXAMPLE 4

The procedure in Example 13 was repeated by using the same image receiving sheet as employed An Example 13 except that 5 parts by weight of a commercially available silicone oil (Trademark "SF8417" / Trademark "SF8411" 1/1 made by Dow Corning Toray Silicone Co., Ltd.) were added to the formulation of the dye transfer contribution layer formation liquid for the formation of the sublimation-type thermal image transfer recording medium employed in Example 13 and that the low dyeable resin layer was eliminated from the sublimation-type thermal image transfer recording medium.

By use of the respective image receiving sheets and sublimation-type thermal image transfer recording media prepared in Examples 12 to 15 and Comparative Examples 3 and 4, image recording was performed in the successive order of yellow, magenta and cyan, and a black image formation was also performed by mixing the three colors, by use of a thermal head with a resolution of 12 dots/mm under the following conditions:

(1) Energy and power applied to the thermal head

| | |
|---|---|
| Applied energy | 0.64 mJ/dot |
| Applied power | 0.16 W/dot |

(2) Running speeds of the image receiving sheet and the image transfer recording medium at recording (14 times different speed ratio)

| | |
|---|---|
| Image receiving sheet | 8.4 mm/sec |
| Image transfer recording medium | 0.6 mm/sec |

The image densities of the yellow, magenta, cyan and black images obtained in Examples 12 to 15 and in Comparative Examples 3 and 4, were measured by use of a Macbeth Reflection Type Densitometer RD-918 (made by Macbeth Co., Ltd.). The results are shown in the following TABLE 5:

TABLE 5

| | Gel Percentage (wt. %) of Image Receiving Layer | Provision of Low Dyeable Resin Layer in Image Transfer Medium | Image Density of Recorded Images Y | M | C | Bk |
|---|---|---|---|---|---|---|
| Ex. 12 | 75 | Provided | 1.93 | 1.77 | 1.70 | 1.67 (*1) |
| Ex. 13 | 98 | Provided | 2.07 | 1.90 | 1.75 | 1.70 (*2) |
| Ex. 14 | 98 | Provided | 2.16 | 1.95 | 1.81 | 1.86 |
| Ex. 15 | 100 | Provided | 2.05 | 1.94 | 2.18 | 1.56 |
| Comp. Ex. 3 | 60 | Provided | 1.90 | 1.75 | 1.66 | 1.50 (*3) |
| Comp. Ex. 4 | 98 | None | 2.08 | 1.67 | 2.18 | 1.50 (*1) |

Note:

*1) Recording was performed with the application of 0.58 mJ/dot because when 0.64 mJ/dot was applied, the image transfer medium stuck to the image receiving sheet.

*2) Recording was performed with the application of 0.60 mJ/dot because when 0.64 mJ/dot was applied, the image transfer medium stuck to the image receiving sheet.

*3) Recording was performed with the application of 0.56 mJ/dot because when 0.64 mJ/dot was applied, the image transfer medium stuck to the image receiving sheet.

The results shown in TABLE 5 indicate that no fusing took place in Examples 12 to 15 even when recording was performed in a different running speed mode, with the application of high energy. Furthermore, the formation of images not only with a single color, but also with a mixed color, is also possible with high image density.

These advantageous effects cab be conspicuously obtained when the gel percentage of the image receiving layer is 98 wt. % in view of the results in Examples 13 and 14.

According to the present invention, when the gel percentage of the gel percentage of the image receiving layer of the image receiving sheet is 70 wt. % or more, the image receiving sheet has excellent releasability and can be applied to the recording in the different running mode without causing the fusing or sticking of the image transfer medium to the image receiving sheet.

When the gel percentage of the dye receiving layer of the image receiving sheet is in the range of 90 to 99 wt. %, the decrease of the dyeability of the dye receiving layer can be appropriately prevented and controlled.

In the image receiving sheet of the present invention, when the dyeable cured resin for use in the image receiving layer is a reaction product of a vinyl chloride-based resin containing active hydrogens and an isocyanate compound, the dyeability of the image receiving layer can be improved.

In the image receiving sheet of the present invention, when the above-mentioned isocyanate compound is an aromatic isocyanate compound, the above-mentioned gel percentage of the dye receiving layer of the image receiving sheet can be easily obtained because of the high reactivity of the aromatic isocyanate compound.

In the image receiving sheet of the present invention, when the dye receiving layer further comprises a tin compound, the curing temperature of the dye receiving layer can be lowered because of the catalytic effect of the tin compound.

In the image receiving sheet of the present invention, when the substrate comprises a micro-bubbles containing film, uniform printing can be attained even by the different running mode recording method.

In the image receiving sheet of the present invention, when the micro-bubbles containing film comprises at least two laminated film layers, which may be the same or different, not only the formation of non-uniform images, but also the curling of the image receiving sheet can be effectively prevented.

In the image receiving sheet of the present invention, when the micro-bubbles containing film has a density D which satisfies the formula:

$$\frac{(D_o - D)}{D_o} > 0.3$$

wherein $D_0$ is the density of a bubble-free film which is made of the same material as that for the micro-bubbles containing film, the obtained image density can be improved, and the thermosensitivity of the image receiving sheet, in particular, in the portion where low printing energy is applied, can be improved.

In the sublimation-type thermal image transfer recording method for recording images of the present invention, which comprises the steps of (1) superimposing (a) a sublimation-type thermal image transfer recording medium which comprises a plurality of overlaid ink layers, at least one of which comprises a sublimable dye, with the top ink layer thereof being a low dyeable resin layer, on (b) the image receiving sheet of the present invention, and (2) applying heat imagewise to the image transfer recording medium to imagewise sublime or transfer the sublimable dye contained in the ink layer onto the image receiving sheet in a different running speed mode, in which both of the image receiving sheet and the sublimation-type thermal image transfer medium are caused to run with the running speed of said image transfer recording medium being set at 1/n (n>1) times the running speed of the image receiving sheet, no fusing of the image transfer recording medium takes place, and the formation of images not only with a single color, but also with a mixed color, is also possible with high image density, with the prevention of the reverse transfer of the dye from the image receiving sheet to the image transfer recording medium because of the provision of the low dyeable resin layer in the image transfer recording medium.

In the above-mentioned sublimation-type thermal image transfer recording method, when at least the lowermost ink layer of the overlaid ink layers is a dye supply layer which comprises the sublimable dye and an organic binder agent in which the sublimable dye is dispersed, the sublimable dye can be present in the form of particles, so that the sublimable dye can be discharged from the dye supply layer into the upper overlaid layers in the form of individually separated molecules in a suitable manner for multiple recording.

Therefore, even when the image transfer recording medium is used multiple times, and the number of the use thereof is increased, high image density can be obtained.

In the above-mentioned sublimation-type thermal image transfer recording method of the present invention, when the low dyeable resin layer comprises a silicone resin, higher heat resistance and releasability, and lower dyeability are imparted to the image transfer recording medium, so that the fusing of the image transfer recording medium when high energy is applied thereto, and the reverse transfer of the sublimable dye from the image receiving sheet to the image transfer recording medium can be effectively prevented.

In the above-mentioned sublimation-type thermal image transfer recording method, when images recorded have a black color which is produced by a subtractive mixing method using yellow, magenta and cyan, the necessary image transfer sheets are only yellow, magenta and cyan image transfer sheets, and the running cost thereof is low. Furthermore, images with high density can be produced by this sublimation-type thermal image transfer recording method.

Japanese Patent Application No. 05-235068 filed on Sep. 21, 1993, and Japanese Patent Application No. 06-166329 filed on Jun. 24, 1994 are hereby incorporated by reference.

What is claimed is:

1. An image receiving sheet for thermal image recording comprising:

a substrate; and a dye receiving layer which is formed on said substrate directly or through an intermediate layer, said dye receiving layer comprising a dyeable cured resin and having a gel percentage of 70 wt. % or more.

2. The image receiving sheet as claimed in claim 1, wherein the gel percentage of said dye receiving layer is in the range of 90 to 99 wt. %.

3. The image receiving sheet as claimed in claim 1, wherein said cured resin is a reaction product of a vinyl chloride-based resin containing active hydrogens and an isocyanate compound.

4. The image receiving sheet as claimed in claim 3, wherein said isocyanate compound is an aromatic isocyanate compound.

5. The image receiving sheet as claimed in claim 3, wherein said dye receiving layer further comprises a tin compound.

6. The image receiving sheet as claimed in claim 1, wherein said substrate comprises a micro-bubbles containing film.

7. The image receiving sheet as claimed in claim 6, wherein said micro-bubbles containing film comprises at least two laminated film layers.

8. The image receiving sheet as claimed in claim 6, wherein said micro-bubbles containing film has a density D which satisfies the formula:

$$\frac{(D_o - D)}{D_o} > 0.3$$

wherein $D_0$ As the density of a bubble-free film which is made of the same material as that for said micro-bubbles containing film.

9. A thermal image transfer recording method for recording images comprising the steps of:

superimposing (a) a thermal image transfer recording medium which comprises a plurality of overlaid layers, at least one of which comprises a sublimable dye, with the top layer of said recording material being a low dyeable resin layer, on (b) an image receiving sheet which comprises a substrate and a dye receiving layer formed thereon directly or through an intermediate layer, which dye receiving layer comprises a cured resin and has a gel percentage of 70 wt. % or more and is capable of receiving said sublimable dye imagewise by thermal image transfer recording said dye receiving layer, and applying heat imagewise to said image transfer recording medium to imagewise sublime or transfer said sublimable dye onto said image receiving sheet in a different running speed mode, in which both of said image receiving sheet and said thermal image transfer medium are caused to run with the running speed of said image transfer recording medium being set at 1/n (n>1) times the running speed of said image receiving sheet.

10. The thermal image transfer recording method as claimed in claim 9, wherein at least the lowermost layer of said overlaid layers is a dye supply layer which comprises said sublimable dye and an organic binder agent in which said sublimable dye is dispersed.

11. The thermal image transfer recording method as claimed in claim 9, wherein said low dyeable resin layer comprises a silicone resin.

12. The thermal image transfer recording method as claimed in claim 9, wherein said images recorded have a black color which is produced by a subtractive mixing method using yellow, magenta and cyan.

13. The thermal image transfer recording method as claimed in claim 9, wherein the gel percentage of said dye receiving layer is in the range of 90 to 99 wt. %.

14. The thermal image transfer recording method as claimed in claim 9, wherein said cured resin is a reaction product of a vinyl chloride-based resin containing active hydrogens and an isocyanate compound.

15. The thermal image transfer recording method as claimed in claim 14, wherein said isocyanate compound is an aromatic isocyanate compound.

16. The thermal image transfer recording method as claimed in claim 14, wherein said dye receiving layer further comprises a tin compound.

17. The thermal image transfer recording method as claimed in claim 9, wherein said substrate comprises a micro-bubbles containing film.

18. The thermal image transfer recording method as claimed in claim 17, wherein said micro-bubbles containing film comprises at least laminated film layers.

19. The thermal image transfer recording method as claimed in claim 17, wherein said micro-bubbles containing film has a density D which satisfies the formula:

$$\frac{(D_0 - D)}{D_0} > 0.3$$

wherein $D_0$ is the density of a bubble-free film which is made of the same material as that for said micro-bubbles containing film.

* * * * *

UNITED STATES PATENT AND TRADEMARK OFFICE

CERTIFICATE OF CORRECTION

PATENT NO. : 5,525,573

DATED : June 11, 1996

INVENTOR(S) : Hiroyuki UEMURA, et al.

It is certified that error appears in the above-identified patent and that said Letters Patent is hereby corrected as shown below:

Column 2, line 54, "an (li) applying" should read
--an (ii) applying--.

Column 3, line 59, "hydrogens ere employed" should read
--hydrogens are employed--.

Column 4, line 1, "end" should read --and--.
line 39, "such as copolymere" should read
--such as copolymers--.
line 62, "such an adhesive" should read
--such as adhesive--.

Column 5, line 7, "frame become rough" should read
--from becoming rough--.

Column 6, line 4, "polyimide resin" should read
--polyamide resin--.
line 17, "sublime or ere" should read
--sublime or are--.
line 23, "Disperse Rede" should read
--Disperse Reds--.
line 54, Delete "o,".

UNITED STATES PATENT AND TRADEMARK OFFICE

CERTIFICATE OF CORRECTION

PATENT NO. : 5,525,573

DATED : June 11, 1996

INVENTOR(S) : Hiroyuki UEMURA, et al.

It is certified that error appears in the above-identified patent and that said Letters Patent is hereby corrected as shown below:

Column 7, line 6, "although e suitable" should read --although a suitable--.

line 19, "separately farmed" should read --separately formed--.

line 23, "dye supply layer end" should read --dye supply layer and--.

Column 8, line 34, "polyimide film" should read --polyamide film--.

line 65, "polyimide or aromatic" should read --polyamide or aromatic--.

Column 10, line 22, "image racclying" should read --image receiving--.

Column 11, line 41, "O denotes" should read --◎ denotes--.

Column 12, line 51, "compound ((Trademark" should read --compound (Trademark--.

Column 14, line 28, "Part by Weight" should read --Parts by Weight--.

Column 17, line 16, "employed An Example" should read --employed in Example--.

UNITED STATES PATENT AND TRADEMARK OFFICE

CERTIFICATE OF CORRECTION

PATENT NO. : 5,525,573

DATED : June 11, 1996

INVENTOR(S) : Hiroyuki UEMURA, et al.

It is certified that error appears in the above-identified patent and that said Letters Patent is hereby corrected as shown below:

Column 18, line 12, TABLE 5, under "M" Column, "1.67" should read --1.87--.

line 28, "effects cab be" should read --effects can be-

Column 20, line 43, "wherein $D_o$ As the" should read --wherein $D_o$ is the--.

Column 22, line 9, Insert "two" after "least."

Signed and Sealed this

Fourth Day of November, 1997

*Attest:*

*Attesting Officer*

BRUCE LEHMAN

*Commissioner of Patents and Trademarks*